US009247798B2

(12) United States Patent
Sanchez-Martinez et al.

(10) Patent No.: US 9,247,798 B2
(45) **Date of Patent: *Feb. 2, 2016**

(54) EPILATING DEVICE

(75) Inventors: Pedro Sanchez-Martinez, Kronberg/Taunus (DE); Bernhard Kraus, Braunfels (DE); Frieder Grieshaber, Neu-Anspach (DE)

(73) Assignee: Braun GmbH, Kronberg (DE)

( * ) Notice: Subject to any disclaimer, the term of this patent is extended or adjusted under 35 U.S.C. 154(b) by 294 days.

This patent is subject to a terminal disclaimer.

(21) Appl. No.: 12/679,910

(22) PCT Filed: Aug. 7, 2008

(86) PCT No.: PCT/EP2008/006478

§ 371 (c)(1),
(2), (4) Date: May 28, 2010

(87) PCT Pub. No.: WO2009/052880

PCT Pub. Date: Apr. 30, 2009

(65) Prior Publication Data

US 2010/0234858 A1 Sep. 16, 2010

(30) Foreign Application Priority Data

Oct. 24, 2007 (DE) ..... 10 2007 050 661

(51) Int. Cl.
*A45D 26/00* (2006.01)
*B26B 21/00* (2006.01)
(Continued)

(52) U.S. Cl.
CPC ..... *A45D 26/0028* (2013.01); *A45D 26/0061* (2013.01); *B26B 21/00* (2013.01); *A45D 34/04* (2013.01); *A45D 2026/0095* (2013.01); *A45D 2200/1054* (2013.01); *B26B 21/44* (2013.01)

(58) Field of Classification Search
CPC ..... B26B 19/00; B26B 19/265; B26B 19/38; B26B 21/00; B26B 21/44; A45D 26/0023; A45D 26/0042; A45D 2026/0095; A61B 2017/00752
USPC ..... 606/131, 133; 30/34.1
See application file for complete search history.

(56) References Cited

U.S. PATENT DOCUMENTS 4,922,608 A * 5/1990 Pahl ..... 30/43.91
5,784,790 A 7/1998 Carson, III et al.
(Continued)

FOREIGN PATENT DOCUMENTS

DE 4143514 C2 8/1997
EP 1797788 6/2007
(Continued)

OTHER PUBLICATIONS

International search report dated Nov. 25, 2008 containing 3 pages.

*Primary Examiner* — Sarah W Aleman
(74) *Attorney, Agent, or Firm* — Ronald Terk Sia; Kevin C. Johnson; Steven W. Miller

(57) ABSTRACT

An epilator (100) comprising an epilating unit (1) for plucking and/or pulling hair (51) out of the skin (50) over an epilating width (E). Such an epilator is disadvantageous in that typically not all of the hairs are detected by the epilating unit (1) and some remain in the skin after the epilation. A subsequent epilation would then be required. In order to solve this problem, the epilator (100) has a hair removal unit (2) following the epilating unit (1) in the direction (B) of use, such that, in at least one operating mode, the hair removal unit (2) removes the hairs (51) that have not been pulled out by the epilating unit (1).

7 Claims, 3 Drawing Sheets

Figure 1:
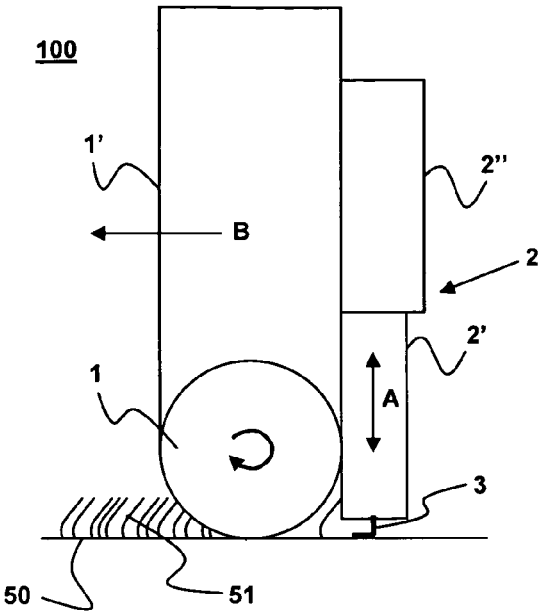

(51) Int. Cl.
*B26B 21/44* (2006.01)
*A45D 34/04* (2006.01)

(56) References Cited

U.S. PATENT DOCUMENTS

| | | | | |
|---|---|---|---|---|
| 5,857,903 | A | 1/1999 | Ramspeck et al. | |
| 5,980,452 | A | 11/1999 | Garenfeld et al. | |
| 6,165,182 | A | 12/2000 | Caric et al. | |
| 6,322,569 | B1 | 11/2001 | Sueyoshi et al. | |
| 6,913,606 | B2 | 7/2005 | Saitou et al. | |
| 7,832,104 | B2 | 11/2010 | Yamasaki et al. | |
| 2002/0066186 | A1 | 6/2002 | White et al. | |
| 2002/0161380 | A1 | 10/2002 | Saitou et al. | |
| 2005/0288687 | A1 | 12/2005 | Dorber et al. | |
| 2007/0066979 | A1 * | 3/2007 | Beytollahi | 606/133 |

FOREIGN PATENT DOCUMENTS

| | | | | |
|---|---|---|---|---|
| JP | 56-100088 | | 8/1981 | |
| JP | 57-180384 | | 11/1982 | |
| JP | 59-85168 | U | 6/1984 | |
| JP | 07-289350 | A | 11/1995 | |
| JP | 11187924 | A | 7/1999 | |
| JP | 2000060629 | | 2/2000 | |
| JP | 2001-70035 | A | 3/2001 | |
| WO | WO 98/07551 | * | 2/1998 | B26B 19/42 |
| WO | WO-2004/033165 | | 4/2004 | |
| WO | WO-2007/033746 | A1 | 3/2007 | |

* cited by examiner

EPILATING DEVICE

The invention relates to an epilator with an additional hair removal unit.

From Patent Document DE 41 514 C2, an epilator is known having a epilating head with clamping elements, wherein the clamping elements serve to catch hairs between each two adjacent clamping elements, wherein plucking elements on movable clamping elements operate in such a way that hairs are clamped between each movable clamping element and an immovable clamping element and are then plucked out of the skin. A trimmer for cutting hair to a short length is arranged in front of the epilating head in the direction of feed which cuts the hairs, which are then plucked out by the epilating head.

This known epilator first cuts the hair with the trimmer to a uniform length, so that the epilator can pluck out hair of uniform length. In this way, problems are avoided that would arise from plucking out long hair.

Such an epilator has the disadvantage that, because of the typically imperfect efficiency of the epilating head, the epilator must be passed over the same skin area several times in order to achieve a complete removal of hair. This is both time consuming and also prolongs the time during which the user experiences pain while the hair is being plucked out.

From WO 98/07551 a hair removal unit is known which can pluck out hairs by clamping entirely or over an adjustable section. If the hair is only partially plucked out of the skin, the hairs which are clamped and partially plucked out are cut off by a cutting unit. In this way, the user can choose between a painful plucking, but longer lasting, smoother hair removal and a less painful pulling with cutting, but less long lasting smooth skin.

From DE 600 20 901 T2 an epilator is known which has two pull-out heads, arranged one behind the other in the direction of use.

The disadvantage of this hair removal unit is that hairs which are not clamped by a first pass remain in the skin, making one or more passes necessary in order to achieve acceptably smooth skin.

An object of the present invention is to provide an epilator and a method with which hair removal is achieved that essentially makes it unnecessary to pass over the same area of skin more than once and that nevertheless offers an acceptable hair removal outcome.

This object is achieved with an epilator according to claim 1. Further embodiments of the invention are specified in the dependent claims.

In addition to the epilating unit for pulling or plucking out hair from the skin over an effective epilating swath, an additional hair removal unit is provided with the epilator which works without plucking, which serves to remove hair by cutting off or shaving off hairs that still remain after the epilating unit has passed over the skin. The hair removal unit is therefore independent of the epilating unit in its hair removing action, i.e., in contrast to the method known from WO 98/07551, in which the hair is cut off only when the hairs are clamped; in this device, in at least one operating mode of the epilator, all the hairs still remaining in the skin after the epilating unit are fed into the hair removal unit and are removed by it. This allows a practically complete removal of hair in one pass, that is, in one operation of the epilator. In this way, the need for passing the epilator over a skin region again that has already passed over by the epilator in order to remove hairs remaining in the skin, which would lead to further painful plucking operations, is avoided. The additional hair removal unit removes the hairs remaining in the skin by shaving or cutting them off, neither of which causes much noticeable pain. In contrast to this, for example, in DE 600 20 901 T2, a second plucking head is provided such that a greater plucking efficiency is accompanied by greater pain from plucking. In various embodiments, the hair removal unit is designed as one or more razor blades or blade cartridges, as a hair trimmer, or as a shaving foil shaver or as a combination of these. An embodiment as a razor blade or blade cartridge is easy to produce, because one blade takes up little room and typically is not electrically driven (however, a vibrational motion for the blade can be provided).

In a further embodiment of the epilator, the hair removal unit operates only over the epilating width, i.e. it is arranged on the epilator in such a way that the hair removal function of the hair removal unit passes maximally only over the epilating width on one pass over the skin in the direction of use of the epilator. If the hair removal effect of the hair removal unit were to operate over a broader width, the strips of hair not plucked out would be cut or shaved, which, when the hair grows back, would result in strips of faster-growing hair, because the plucked out hair takes longer to grow back.

In a further embodiment, the hair removal unit is designed as a detachable unit, in particular as an attachment. The hair removal unit, for example, can be clamped to the epilator in a known manner, such that the hair removal unit is locked in place in this position. In this way, the hair removal unit is detachably mounted. This allows the user to use the epilator either without the additional hair removal unit or with the additional hair removal unit, depending on the tolerance of pain and also on the desired length of time intended for the use, because hair removal is accomplished in less time when it takes place in one pass (in one operation) than when several epilations of one skin area are carried out.

In another embodiment of the epilator, an application unit is mounted in front of the epilating unit. The application unit can be designed, for example, as a liquid dispenser or as an applicator for an application provided as a solid substance. The liquid dispenser can apply liquid, which can also be a lotion, a gel or a crème, onto the skin my means of spraying on, applying through an orifice, rolling on, etc. In this connection, the liquid can have cooling ingredients, for instance menthol, such that the pain of epilating is eliminated. The liquid can also contain skin care ingredients. In particular, but not exclusively, when the liquid dispenser is attached behind the epilating unit and in front of the hair removal unit, the liquid dispenser can apply shaving foam to the skin, for example, which allows a clean and pleasant shaving experience due to a hair removal unit designed as a razor blade or blade cartridge. The applicator can contain, for example, a bar of soap, held against the skin by light spring pressure, for example. The soap is then applied to the skin by abrasion or, when used in the shower, by dissolving it in water. Instead of a bar of soap, other items can be applied via the applicator, such as are known with blade cartridges for wet shaving, for example, wherein Vitamin E and Aloe vera are applied by means of a strip.

In one embodiment, the hair removal unit can be slid between several positions or operating positions, wherein a first position or operation position of a hair removal unit arranged in the after position, allows hair removal after the epilating, and wherein the hair removal unit in the second position or operating position does not take part in hair removal. The second position can be a position in which the hair removal unit is displaced within the epilator (and is perhaps positioned under a cover) or it can be a position in which the hair removal unit remains visible, but is retracted away from the skin surface.

In a further embodiment, the epilator has a skin and/or hair impacting unit. The skin and/or hair impacting unit can be designed, for example, as a roller with pointed protrusions, wherein the points of the roller induce a pain in the nerves so that the plucking pain when epilating is no longer felt as strongly. The skin and/or hair impacting unit alternatively can be designed as a comb or as an agent for making the hair stand up. In one embodiment, the skin and/or hair impacting unit is equipped with an exfoliating head, which removes loose skin flakes via an abrasive effect, thus creating the impression of a younger, refreshed skin. Other embodiments are, for example: massage roller, (driven) peeling attachments, etc. The different forms of skin and/or hair impacting units can also be provided in combinations. The skin and/or hair impacting units can be arranged either in front of or behind the epilating unit. Several skin and/or hair impacting units can also be provided, for example, a mechanical skin stimulator in front of the epilator and an exfoliation head behind the hair removal unit.

In a further embodiment, the epilator has a pivoting or tilting hair removal unit attached to it such that the hair removal unit can be brought into the correct operational angle to the skin for use, even when the epilator is tilted.

In another embodiment, the epilator has means to adjust the efficiency of the epilator, for example, in that the individual clamping devices can be deactivated. Such means for modifying the efficiency are described, for example, in EP 1 581 074 (WO 2004/054401 A1) and in EP 1 797 788 A1.

In a further embodiment, the epilator has means to adjust the ratio of processes in which the hair is completely plucked out to the processes in which the hair is merely pulled, but is not plucked out. Such a means can be, in particular, a device for adjusting the clamping force of individual clamping devices, because when a clamping force is set low, the hair is only tugged before it can no longer be held by the clamping device against the force of the hair root, and is then pulled out of the clamping device. Hairs tugged in this way are pulled partially out of the hair canal. Because of the viscoelastic properties of skin, such hairs are slowly pull back into the hair canal and can therefore be cut off by the hair removal unit before they are completely retracted into the hair canal. This leads to a smoother and longer lasting hair removal result than does just the mere removal of the hair.

The invention also relates to a hair removal unit to be attached to an epilator, such that an epilator as described can be obtained.

The invention also relates to a method for removing hair, wherein, with this method, the hair is first pulled or plucked out over an epilating width; thereafter, the hair remaining in the skin is cut off or shaved off, wherein the plucking out or pulling of the hair and the removal is accomplished in one single operation (but separate from each other). In a further embodiment of this method, an application substance is applied to the skin (for example, a liquid, a crème or lotion, soap or a solid substance applied by abrasion, for example). This can take place, for example, in one pass (in one operational use), but it can also precede the hair removal, for example, in the form of applying the application substance to the skin with a cloth.

The invention is further explained below by the exemplary examples and discussed in detail with reference to the figures.

Figure 2:
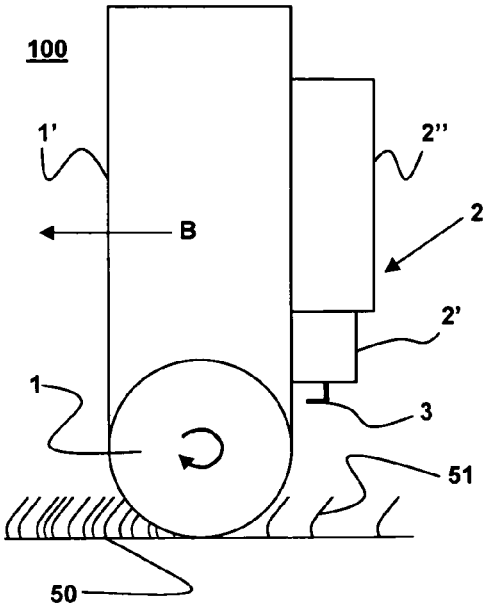
Figure 3:
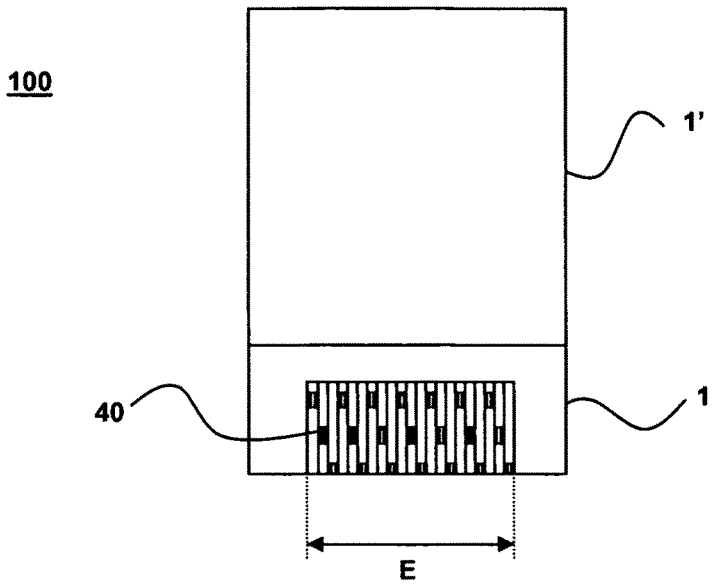
Figure 4:
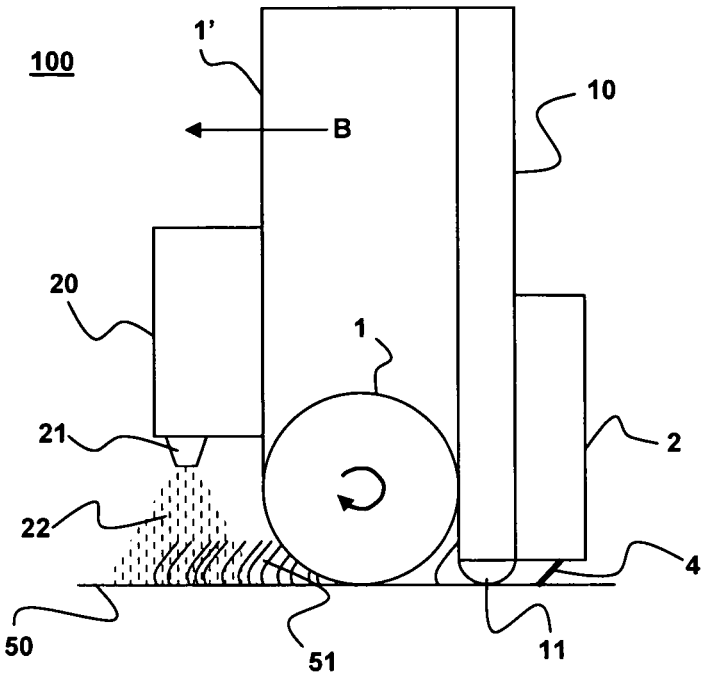

FIG. 1 shows a schematic drawing of an epilator with a hair removal unit following an epilating unit in the direction of use, FIG. 2 shows a schematic drawing of the epilator of FIG. 1 in an operational mode in which the hair removal unit is locked in a position which allows no subsequent hair removal FIG. 3 shows a front view (counter to the direction of use) of the schematic epilator according to FIG. 1 or FIG. 2, and FIG. 4 shows a schematic drawing of an epilator in another embodiment, with a liquid dispenser and a skin and/or hair impacting unit.

In FIG. 1, an epilator 100 is schematically shown having an epilating unit 1 arranged on an epilator base body 1' and a hair removal unit 2 separated from this in its hair removing function. The fact that the epilator 1 and the hair removal unit 2 are separate from one another in their hair removing function means that the hair that has not been plucked out by the epilator can be removed by the hair removal unit 2 positioned following in the direction of use. The epilating unit 1 can be, for example, a known rotating cylinder with paired individually activated clamping elements that hold hairs in a plucking zone by clamping with paired clamping contacts on the clamping device, and pluck them out of the skin as the rotating cylinder continues to rotate. Such an epilator is described, for example, in Patent Document EP 0 921 744 B1. Other known epilating units or further embodiments of epilating units can also be used, of course, as an epilating unit 1 in the epilator 100. The hair removal unit 2 in this embodiment consists of a hair trimmer 2' which has a hair trimmer unit 3 with a fixed cutting element (comb) and a moving cutting element (blade) oscillating linearly with respect to the fixed cutting element, and is float mounted in a trimmer housing 2" in a direction A. The hair removal unit 2 can be designed so as to be removable and fastened on the epilator base body 1' and the hair removal unit 2, for example, by means of clamping devices attached to one another by positive fit. The hair removal unit 2 can have its own energy source and/or its own drive (neither of which is shown) or the hair removal unit 2 can be connected by electrical contact to the energy source in the epilator base body 1'. Alternatively, the hair removal unit 2 can be connected by a drive to a drive unit in the epilator base body 1'.

To remove hair 51, the epilator 100 is passed over the skin 50 of the user in a direction of use B. The epilating unit 1 removes the hairs 51 by plucking them out over an epilating width defined by the functional width of the epilating unit (reference symbol E in FIG. 3). Alternatively, the epilating unit 1 can remove the hair 51 by pulling the hairs that have been clamped and by subsequently cutting the clamped hairs near the surface of the skin (as described in WO 98/07551 A1, for example). In both implementations of an epilating unit, the hairs 51 that were not grasped by the epilating unit 1 remain in the skin 50. The hair removal unit 2 removes the hairs 51 remaining in the skin 50 at or near the surface of the skin, without a plucking operation; in the embodiment illustrated, this is achieved by a hair removal unit 2 designed as a hair trimmer—alternatively, however, the hair removal unit 2 can also be designed as blades or blade cartridges or as a shaving foil shaver.

Because the plucking operation causes pain, it is especially unpleasant for users that are using an epilator for the first time or who have a low pain threshold if the duration of painful hair removal is prolonged by the need to pass the epilator 100 over the same section of skin several times, in order to pluck out the hairs 51 during an additional epilating operation that were not plucked out in the course of a first epilating operation. The described epilator 100 removes hairs 51 which remain in the skin after using the epilating unit 1, by means of a painless cutting or shaving process of the hair removal unit 2. The hair removal outcome is then very good, because no long hairs remain in the skin. The perception of pain is reduced. When using a blade or a blade cartridge, the feel of the skin after hair has been removed with a single pass is especially pleasant, because when the cutting process involves one or more blades, dead skin also removed, making the skin especially smooth.

At the same time, the epilator 100 can be designed to be used for wet hair removal (in the shower, for example), that is, designed to be washable and water proof with respect to the electrical components.

In an alternative embodiment, the epilating unit 1 is provided with means allowing a lower plucking efficiency to be set over the epilating width (reference symbol E in FIG. 3). This can be accomplished, for example, by covering individual rows of clamping pairs of tweezers. Such an attachment is described in EP 1 581 074. Instead of an attachment, however, the clamping pressure between the clamping tweezers of the epilating unit 1 can be reduced, so that there is a higher probability that the hairs will slip out of the clamps before they are completely pulled out of the skin. In this case, such hairs are only tugged. After being tugged, the hairs retract back into the hair canal, which does not happen immediately because of the viscoelastic characteristics of the skin. The hairs that are tugged in this way are then cut by the hair removal unit 2 before they completely retract back into the hair canals. In this way, the pain of plucking out hair is reduced, but an exceptional hair removal result is nevertheless obtained.

In FIG. 2, the epilator 100 is shown in a different operating mode in which a hair removal unit 2 is locked in a position recessed from the skin surface 50 and does not take part in the hair removal process. In this way, in the illustrated embodiment, the hair trimmer 2' is inserted into the trimmer housing 2". The epilating unit 1 is passed over the surface of the skin 50 of the user in a direction of use B. Because the epilating efficiency of the epilating unit 1 is typically imperfect, hairs 51 remain in the skin 50 in the skin area already passed over with the epilator 100. The experienced user, for whom the plucking pain is not important, but who anticipates a longer hair removal session, can then, in additional epilating processes, pass over the same skin areas until no hair remains in the skin. Alternatively or additionally to the illustrated retracted position of the hair removal unit 2, the hair removal unit 2 can be designed as an attachment that can be locked in place or detached, which is placed, for example, over the epilating unit 1 and remains aligned when the epilator is inclined tangentially to the skin surface, because it is designed to be turned or tilted.

FIG. 3 shows a frontal view of the epilator 100 (seen from the side opposite the direction of use of the epilator 100). The epilator 100 has a epilator base body 1' and an epilating unit 1, wherein the epilating unit 1 is operative over an epilating width E (which lies in the surface of use perpendicular to the direction of use B, i.e., the distance traversed in the direction of use B, multiplied by the epilating width E, yields the skin area covered, within which the hair is removed). The epilating unit 1 has a clamping device 40, which is comprised of paired disc clamping tweezers, which are rotated open on the skin in a known manner, so that hairs can be fed between the disc clamping tweezers, whereby the disc clamping tweezers close into the plucking position and clamp the hairs and pull them out of the skin as the discs continue to rotate. In one embodiment, the hair removal unit arranged behind the epilating unit 1 shown in the frontal view, is maximally operative only over the above-mentioned epilating width E of the epilating unit 1. A wider hair removal unit would remove all hair to either side of the epilating width E, which can result in hair stripes as the hair grows back, which gives an undesirable visual and aesthetic impression.

FIG. 4 shows an epilator 100 in which an epilating unit 1 is arranged on an epilator base body 1' and which, in front of the epilating unit 1 viewed from the direction of use B, additionally has an applicator unit 20, which is here designed as a liquid dispenser and which sprays a liquid mist 22 through a nozzle 21 onto the skin surface 50 and the hair 51. In particular, the liquid can contain a cooling active ingredient (menthol, for example), the cooling effect of which would reduce the perceived pain of plucking. The liquid can also contain different or additional ingredients, such as, for example, perfume, a skin pre-treatment agent, etc. The liquid dispenser 20 can alternatively apply the liquid to the skin and hair by means of a roller provided with a liquid via a liquid container, or the liquid dispenser can apply the liquid by means of a cloth saturated with liquid. In this connection, liquid is also understood to be a lotion or a crème. Of course, other typical application methods are likewise comprised by the description.

In the embodiment of the epilator 100 according to FIG. 4, the hair removal unit 2 attached behind the epilating unit 1 in the direction of use B is provided with a sharp edged blade 4, wherein the blade can be designed as a razor blade, for example, with an edge radius of approximately 30 nm, or as a somewhat dull cutting edge with an edge radius of approximately 1 μm. In the latter case, the blade lasts longer than with the very sharp edged razor blade, and the blade would need to be replaced less often. Alternatively, the blade can be made of a ceramic material, as is known from ceramic kitchen knives. A ceramic material has the advantage that a curved blade which follows the outer shape of a convex epilator housing, can be produced relatively easily, because the shape can be preset by sintering a ceramic powder. An ergonomic contour can also be produced that follows the typical curve of the skin surface over bone. Instead of a single blade 4, the hair removal unit 2 can also have a blade cartridge, as are known in wet shavers. Additionally or alternatively, an application unit 20 can be arranged between the epilating unit 1 and the hair removal unit 2 and, in the embodiment as a liquid dispenser, can then also apply a liquid as an application substance, for example, a shaving foam or shaving gel, that assists the shave by the blade 4 and optionally also cares for the skin, such that one pass of the hair removal process will accomplish not only a good hair removal outcome, but also will impart a pleasant feel to the skin. Instead of being designed as a liquid dispenser, the application unit can also be designed as an applicator for applying an application substance provided as a solid material. In this way, for example, an application substance (a shaving soap, for example), can be present as a block on the applicator, wherein the application substance can be applied by means of abrasion or by dissolving it with liquids present on the skin (optionally also via skin oil).

FIG. 4 also shows a hair and skin impacting unit 10 designed to mechanically impact the skin and/or hair, which in the present case is an exfoliation head 11, which removes dead skin cells by means of an abrasive roller, thus contributing to the impression of younger, fresher skin after the hair removal process. The hair and skin impacting unit 10 can, of course, be configured behind the hair removal unit 2 in the direction of use B. Additionally or alternatively, the hair and skin impacting unit 10 can have a comb after the epilating unit 1, which straightens up the hairs 51 remaining in the skin, so that the hair removing unit 2 can better remove them. The hair and skin impacting unit 10 can also use other typical methods to mechanically impact the hair and skin. In this connection, the hair and skin impacting unit 10 can be provided with a toothed roller which generates small pain impulses to the nerves in the skin, in order to reduce the pain of plucking and, for this purpose, is arranged in the direction of use B in front of the epilating unit 1.

The application unit 20, hair and skin impacting unit 10, and hair removal unit 2 can be integrally connected to the epilator base body 1', or they can be designed together in a body or each as a separate detachable unit.

What is claimed is:

1. An epilator (100) with an epilating unit (1) for pulling out or plucking out hair (51) from the skin (50) over an epilating width (E), wherein a hair removal unit (2) is provided behind the epilating unit (1) in the direction of use (B), so that, in at least one operating mode, by cutting or shaving, in one pass of the epilator, the hair (51) that is not clamped and removed by the epilator unit (1) is removed by the hair removal unit (21), wherein the hair removal unit (2) is a razor blade (4) or a blade cartridge, wherein a skin and/or hair impacting unit (10) is arranged on the epilator (100), between the epilating unit (1) and the hair removal unit (2).

2. The epilator (100) according to claim 1, wherein the hair removal unit (2) is operative maximally over the epilating width (E).

3. The epilator (100) according to claim 1, wherein the hair removal unit (2) is designed as a detachable unit.

4. The epilator (100) according to claim 1, wherein an application unit (20) is arranged in front of or behind the epilating unit (1), which, in one operating mode, applies an application substance (22) to the skin.

5. The epilator (100) according to claim 1, wherein the epilating unit (1) has a first operating position, in which the hair removal unit (2), removes hair (51) that remains in the skin following the epilating unit by cutting or shaving in the direction of use (B) and has a second operating position in which the hair removal unit (2) is locked in a position retracted from the skin (50) and only the epilating unit (1) removes hair (51) from the skin by plucking it out.

6. An epilator (100) with an epilating unit (1) for pulling out or plucking out hair (51) from the skin (50) over an epilating width (E), wherein a hair removal unit (2) is provided behind the epilating unit (1) in the direction of use (B), so that, in at least one operating mode, by cutting or shaving, in one pass of the epilator, the hair (51) that is not clamped and removed by the epilator unit (1) is removed by the hair removal unit (21), wherein the hair removal unit (2) is a razor blade (4) or a blade cartridge, wherein the hair removal unit (2) is pivot-mounted in such a way that the direction of cutting of the hair removal unit (2) remains aligned for use at an optimal angle to the skin (50) even when the epilator is inclined out of an optimal position for use.

7. An epilator (100) with an epilating unit (1) for pulling out or plucking out hair (51) from the skin (50) over an epilating width (E), wherein a hair removal unit (2) is provided behind the epilating unit (1) in the direction of use (B), so that, in at least one operating mode, by cutting or shaving, in one pass of the epilator, the hair (51) that is not clamped and removed by the epilator unit (1) is removed by the hair removal unit (21), wherein the hair removal unit (2) is a razor blade (4) or a blade cartridge, wherein the epilating unit (1) has means by which the efficiency of the epilating unit (1) can be modified, via at least partial covering of hair clamping devices (40) of the epilating unit (1).

* * * * *